US011801702B2

(12) United States Patent
Boxhammer

(10) Patent No.: US 11,801,702 B2
(45) Date of Patent: Oct. 31, 2023

(54) COATING COMPOSITION, HEAT-SENSITIVE RECORDING LAYER, HEAT-SENSITIVE RECORDING MATERIAL, AND CORRESPONDING USES AND METHODS

(71) Applicant: Mitsubishi HiTec Paper Europe GmbH, Bielefeld (DE)

(72) Inventor: Claas Boxhammer, Herford (DE)

(73) Assignee: MITSUBISHI HITEC PAPER EUROPE GMBH, Bielefeld (DE)

( * ) Notice: Subject to any disclaimer, the term of this patent is extended or adjusted under 35 U.S.C. 154(b) by 526 days.

(21) Appl. No.: 16/966,148

(22) PCT Filed: Jan. 31, 2019

(86) PCT No.: PCT/EP2019/052347
§ 371 (c)(1),
(2) Date: Jul. 30, 2020

(87) PCT Pub. No.: WO2019/149805
PCT Pub. Date: Aug. 8, 2019

(65) Prior Publication Data

US 2021/0031551 A1 Feb. 4, 2021

(30) Foreign Application Priority Data

Jan. 31, 2018 (DE) ..... 10 2018 102 177.1

(51) Int. Cl.
*B41M 5/333* (2006.01)
*B41M 5/337* (2006.01)
*B41M 5/327* (2006.01)

(52) U.S. Cl.
CPC ..... *B41M 5/3333* (2013.01); *B41M 5/3275* (2013.01); *B41M 5/3375* (2013.01); *B41M 2205/04* (2013.01); *B41M 2205/38* (2013.01)

(58) Field of Classification Search
CPC .. B41M 5/323; B41M 5/3275; B41M 5/3333; B41M 5/3375; B41M 2205/04; B41M 2205/38
See application file for complete search history.

(56) References Cited

U.S. PATENT DOCUMENTS 10,160,245 B2 * 12/2018 Horn ..... B41M 5/3333

FOREIGN PATENT DOCUMENTS

DE 3544758 7/1986
DE 3636222 4/1987
(Continued)

OTHER PUBLICATIONS

Office Action of the corresponding German Patent Application No. 10 2018 102 177.1.

(Continued)

*Primary Examiner* — Gerard Higgins
(74) *Attorney, Agent, or Firm* — Cozen O'Connor

(57) ABSTRACT

A coating composition for producing a heat-sensitive recording material and to a corresponding heat-sensitive recording layer. The coating composition includes one or more color developers, one or more dye precursors, one or more specific fatty acid amides, and one or more (additional) specific sensitizers. A heat-sensitive recording material including a carrier substrate and a heat-sensitive recording layer, to the use of specific fatty acid amides in order to increase the grease resistance of a heat-sensitive recording material or a heat-sensitive recording layer, and to a method for producing a heat-sensitive recording material or a heat-sensitive recording layer.

16 Claims, 4 Drawing Sheets

(56) References Cited

FOREIGN PATENT DOCUMENTS

| | | | | |
|---|---|---|---|---|
| DE | 10241903 | | 3/2004 | |
| DE | 102004004204 | | 8/2005 | |
| DE | 102008007596 | | 8/2009 | |
| DE | 102014107567 | | 11/2015 | |
| DE | 102015104306 | | 9/2016 | |
| DE | 112015000518 | | 10/2016 | |
| EP | 2923851 | | 9/2015 | |
| EP | 3000608 | | 3/2016 | |
| JP | 2005288743 | | 10/2005 | |
| JP | 2012-504442 | | 11/2012 | |
| WO | WO 9843824 | | 10/1998 | |
| WO | WO-2015181291 | A1 * | 12/2015 | ..... B05D 1/305 |
| WO | WO 2018065328 | | 4/2018 | |

OTHER PUBLICATIONS

DIN 53107 "Testing of Paper and Board—Determination of The Smoothness By The Bekk Method", May 2016.
DIN EN ISO 787-5 "General Methods of Test For Pigments and Extenders—Part 5: Determination of Oil Absorption Value", Oct. 1995.

* cited by examiner

COATING COMPOSITION, HEAT-SENSITIVE RECORDING LAYER, HEAT-SENSITIVE RECORDING MATERIAL, AND CORRESPONDING USES AND METHODS

CROSS REFERENCE TO RELATED APPLICATIONS

This is a U.S. national stage of Application No. PCT/EP2019/052347 filed Jan. 31, 2019. Priority is claimed on German Application No. DE 10 2018 102 177.1 filed Jan. 31, 2018 the content of which is incorporated herein by reference.

BACKGROUND OF THE INVENTION

1. Field of the Invention

The present invention relates to a coating composition for producing a heat-sensitive recording material and also to a corresponding heat-sensitive recording layer. The coating composition comprises one or plural color developers, one or plural dye precursors, one or plural specific fatty acid amides, and one or plural (further) specific sensitizers. The present invention further relates to a heat-sensitive recording material comprising a carrier substrate and a heat-sensitive recording layer of the invention. The present invention relates, moreover, to the use of specific fatty acid amides for increasing the grease resistance of a heat-sensitive recording material or a heat-sensitive recording layer. The present invention also relates to a method for producing a heat-sensitive recording material of the invention or a heat-sensitive recording layer.

2. Description of Related Art

Heat-sensitive recording materials (e.g., for direct thermal printing applications) which have a heat-sensitive, color-forming recording layer applied on a carrier substrate have been known for many years and are enjoying high popularity. One of the reasons for this popularity is that the use of said materials is associated with the advantage that the color-forming components are contained in the recording material itself and it is therefore possible to use printers free from toner cartridges and ink cartridges. There is therefore no need to purchase and/or fill cartridges of ink or of toner. Accordingly, this innovative technology has become established largely across the board particularly in public transport and in retail.

In a coating composition for producing a heat-sensitive recording material, and in heat-sensitive recording layers of customary recording materials, there is a dye precursor and there is a color developer. On imagewise heating of the heat-sensitive recording layer by a suitable imaging tool, as for example a thermal head or thermal rod, a laser beam, or the like, to a suitable temperature, the coating melts, softens, or sublimes, with the dye precursor and the color developer contacting one another, reacting with one another, and, as a consequence of this chemical reaction, almost immediately forming an image with high color density on the recording material. Preference has been given in recent times, and is also given in the context of the present invention, to the use of nonphenolic color developers.

A heat-sensitive recording material is generally produced by using a coating machine to apply a coating composition for generating a heat-sensitive recording layer to a suitable carrier substrate, i.e., a suitable paper web, a polymeric film, or a corresponding material, then drying the coating composition to give the heat-sensitive recording layer, and optionally smoothing this layer by a calendar. In addition to the heat-sensitive recording layer, preliminary coatings, intermediate coatings and/or finishing coatings may be applied either to one side or to both sides of the recording material. This is also true of a heat-sensitive recording material of the invention.

A coating composition for producing a heat-sensitive recording layer or a heat-sensitive recording material is frequently produced (and is also produced in the context of the present invention) by grinding and dispersing, separately, at least one dye precursor, at least one color developer, and at least one sensitizer to a suitable particle size by bead mills or ball mills, in water or a suitable solvent. The fine dispersions produced accordingly are mixed in the desired ratio with the binders, pigments, lubricant, and release agents, and also with the other customary auxiliaries, which are used together with these fine dispersions as the coating composition for the heat-sensitive recording layer.

DE 10 2014 107 567 B3, according to its independent claim 1, concerns a heat-sensitive recording material comprising a carrier substrate and also a heat-sensitive, color-forming layer comprising at least one color former (i.e., dye precursor), at least one phenol-free color developer, and at least one sensitizer. Paragraph [0014] discloses N-[2-(3-phenylureido)phenyl]benzenesulfonamide (NKK) as color developer. Paragraph [0024] discloses a list of sensitizers which includes—alongside a multiplicity of other compounds—stearamide, 1,2-diphenoxyethane, and 1,2-di(3-methylphenoxy)ethane.

DE 10 2004 004 204 A1, according to its independent claim 1, concerns a heat-sensitive recording material, having a substrate and a heat-sensitive recording layer which comprises a sensitizer, pigment, binder, at least one color former (i.e., dye precursor) and also a phenolic color developer and at least one further organic color developer, the phenolic color developer being selected from the group of the bis (hydroxyphenyl) compounds, and at least one of the further color developers being a urea-urethane compound.

DE 35 44 758 C2, according to its independent claim 1, concerns a paper coating slip which comprises a polyvinyl alcohol resin which contains acetoacetyl groups.

DE 36 36 222 A1, according to its independent claim 1, concerns a heat-sensitive paper set which is able to develop a black image having excellent oil resistance and light stability.

WO 98/43824 A1, according to its independent claim 1, concerns a heat-sensitive recorded sheet having a substrate, a heat-sensitive recording layer comprising color formers (i.e., dye precursors) and color acceptors, and a pigment-containing protective layer which is formed on the recording layer and which comprises a mixture of water-soluble binder and water-insoluble binder.

DE 10 2008 007 596 A1, according to its independent claim 1, relates to a method for producing a recording material, comprising the step of applying a coating which comprises constituents protecting a coating applied in a preceding step from disadvantageous alteration, and comprises a self-crosslinking polyvinyl alcohol in combination with a polyurethane resin.

DE 102 41 903 A1, according to its independent claim 1, concerns a method for producing a layered, heat-sensitive recording material in web form, the recording material comprising at least one substrate, a heat-sensitive recording layer comprising color formers (i.e., dye precursors) and color acceptors, and a protective layer formed on the recording layer.

DE 11 2015 000 518 T5 (Mitsubishi Paper Mills Limited), according to its independent claim 1, concerns a thermal recording material having a heat-sensitive recording layer on a paper carrier, said layer comprising a colorless or slightly colored color origin substance and a developer which reacts with the color origin substance on heating and converts the color origin substance into its color form; the paper carrier comprises a mass fraction of 0.25 to 1.0% of a neutral rosin size, based on the cellulose solids content, in combination with calcium carbonate and aluminum sulfate; and the developer has a phenylureido group in its molecule. The developer in certain embodiments is N-[2-(3-phenylureido) phenyl]benzenesulfonamide. A variety of compounds are listed as suitable sensitizers; alongside a multiplicity of other compounds, the list also embraces monostearamide 1,2-diphenoxyethane, and 1,2-bis(3-methylphenoxy)ethane.

JP 2012-504442 (Hatsume Suishin Kyokai Kokai Giho; published Nov. 22, 2012) discloses a RECORDING MATERIAL PRODUCED USING NON PHENOL COMPOUND (English translation of the title as per translation from the German Opposition procedure relating to the patent DE 10 2014 107 567 B3).

EP 3 000 608 A1, according to its independent claim 1, concerns a heat-sensitive recording material comprising a heat-sensitive recording layer on a carrier, the heat-sensitive recording layer comprising at least one leuco dye and as developer a sulfonamide compound. According to alternative (b) of claim 1, the heat-sensitive recording layer may further comprise a saturated fatty acid amide. According to claim 5, the heat-sensitive recording material may additionally comprise a sensitizer.

DE 10 2015 104 306 A1, according to its independent claim 1, concerns a heat-sensitive recording material comprising a carrier substrate and also a heat-sensitive, color-forming layer comprising at least one color former and at least one phenol-free color developer.

SUMMARY OF THE INVENTION

With the aim of improving heat-sensitive recording materials, especially in the context of their use as tickets or lottery slips, with regard to their resistance to environmental effects such as heat, moisture, and chemicals, there is an ongoing interest in continual onward development of the underlying chemistry and the production technology for generating such recording materials and the coating compositions and recording layers on which these materials are based.

Increasingly in the recent past there have arisen concerns regarding the environmental compatibility particularly of certain (bis)phenolic color developers. Recently then, among the color developers, for example, the well-known components that have been subjects of exceptionally good scientific study, and are known in the form of bisphenol A, namely 2,2-bis(4-hydroxyphenyl)propane, and bisphenol S, namely 4,4-dihydroxydiphenyl sulfone, having increasingly become a focus of public criticism and for that reason have been replaced, for example, completely or partly by NKK, namely N-[2-(3-phenylureido) phenyl]benzenesulfonamide, of the formula

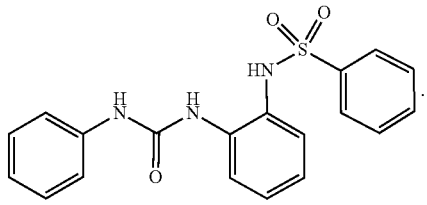

The present invention relates to such a coating composition for producing a heat-sensitive recording material and also to a heat-sensitive recording layer, each comprising NKK as color developer.

In particular there is an ongoing command for further heat-sensitive recording materials for a wide variety of different uses; in view of the high sales volumes of these materials in a keenly fraught market, these materials must be producible at low cost and must therefore possess a simple construction. One particular challenge here is that in the course of their typical uses as gaming tickets, entry tickets, travel tickets, pay parking tickets, and so on, heat-sensitive recording materials are exposed to a multiplicity of different ambient influences, such as moisture, heat, or chemicals.

For instance, during their normal use, heat-sensitive recording materials may come into contact with a multiplicity of different substances that can affect the durability of the thermal printout. These substances, besides water and organic solvents, also include fats and oils that are present, for example, in hand care products and which may become transferred to the heat-sensitive recording material on touching said material. There is therefore also a need for grease resistance on the part of the recording material, so that the recorded image is not destroyed on contact with oily or greasy substances, such as with fatty constituents in haircare products or hand creams, or from skin deposits.

As well as durability to chemicals that may come into contact with the heat-sensitive recording materials, said materials must also be very durable toward thermal influences. On the one hand, the heat-sensitive recording material should be able to be printed easily without excessive energy, so that little energy is consumed in mobile applications, for example. On the other hand, the printed image is to last after printing, and the action of heat should cause neither the printed image to fade nor the unprinted background to discolor, resulting in the print ceasing to be legible. Paid parking tickets which, once printed, are displayed behind the windshield and thereby become exposed in the summer to high temperatures and direct sunlight, are an example of where thermal durability is very much relevant.

Similarly with tickets such as concert tickets or flight tickets, which are frequently produced a long time in advance, or with purchase receipts, which are needed as proof of purchase over a long guarantee period, the long-term durability of the heat-sensitive recording material is very important.

Particularly in view of the potential toxicity of (bis) phenolic chemicals, the development of new, heat-sensitive recording materials ought additionally to minimize or negate entirely the use of (bis)phenolic color developers and to instead give preference to the use of (bis)phenol-free color developers, such as NKK, for instance.

In-house studies have shown that the use of NKK as a color developer within coating compositions and heat-sensitive recording layers of heat-sensitive recording materials, in comparison with conventional, (bis)phenol-containing color developers, has the disadvantageous result of a reduction in the grease resistance of the resulting heat-sensitive recording material. According to the in-house studies, the use of NKK resulted in greatly accelerated retrograde development of color after the direct contact of the heat-sensitive recording material (in a thermal paper) with fats and oils, thereby severely restricting the applications of NKK-containing, heat-sensitive recording materials without a topcoat and so being at the expense of a simple construction of such recording materials.

A primary object of one aspect of the present invention was to specify a coating composition comprising N-[2-(3-phenylureido)phenyl]benzenesulfonamide (NKK) of the formula

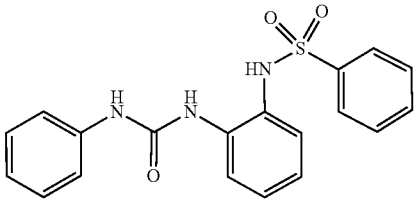

as color developer for producing a heat-sensitive recording material, and also a corresponding heat-sensitive recording layer, which is distinguished by only slow retrograde development of color after direct contact of fats and oils with the recording material provided with a recorded image (i.e., printed). A further object was to specify a corresponding heat-sensitive recording material and also methods for producing said material.

The heat-sensitive recording material to be specified ought also to possess high thermal response sensitivity, high background whiteness and high image density, and an improved durability of the recording generated thereon by means of heat exposure with respect to humidity or heat; this applies corresponding to the coating composition that is to be specified and to the recording layer that is to be specified. The heat-sensitive recording materials ought preferably to exhibit long-term aging even at high temperatures (40 to 60° C.) and possibly high atmospheric humidity.

Further objects are apparent from the description below and from the claims.

The subject matter of the invention is defined in the appended claims and in the description hereinafter.

According to a first aspect of the invention, a coating composition for producing a heat-sensitive recording material, and, respectively, by a heat-sensitive recording layer, comprises one or plural color developers, said one or at least one of the plural color developers being a compound of the formula (I)

(I)

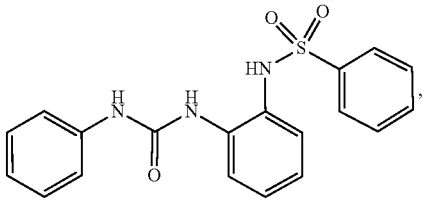

one or plural dye precursors, one or plural fatty acid amides each having a number of carbon atoms in the range from 16 to 24, as sensitizer, one or more compounds selected from the group consisting of 1,2-diphenoxyethane (DPE) and ethylene glycol m-tolyl ether (EGTE), the ratio of the total mass of fatty acid amides having a number of carbon atoms in the range from 16 to 24 to the total mass of compounds selected from the group consisting of 1,2-diphenoxyethane and ethylene glycol m-tolyl ether in the coating composition or the heat-sensitive recording layer being in the range from 4:1 to 1.2:1.

The compound of the formula (I) is, as already indicated earlier on above, NKK, i.e., N-[2-(3-phenylureido)phenyl]benzenesulfonamide.

One aspect of the invention also relates to a corresponding heat-sensitive recording material comprising a carrier substrate and a heat-sensitive recording layer of the invention (as defined above and below, and in the claims).

One aspect of the invention uses a fatty acid amide having a number of carbon atoms in the range from 16 to 24 or of a mixture of plural fatty acid amides each having a number of carbon atoms in the range of 16 to 24, preferably through the use of octadecanamide and/or N-(hydroxymethyl)octadecanamide, for increasing the grease resistance of a heat-sensitive recording material or a heat-sensitive recording layer, comprising one or plural color developers, said one or at least one of the plural color developers being a compound of the formula (I)

(I)

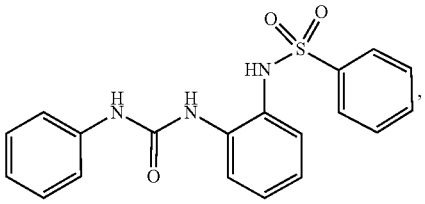

one or plural dye precursors, and as sensitizer, one or more compounds selected from the group consisting of 1,2-diphenoxyethane (DPE) and ethylene glycol m-tolyl ether (EGTE), the ratio of the total mass of fatty acid amides having a number of carbon atoms in the range from 16 to 24 to the total mass of compounds selected from the group consisting of 1,2-diphenoxyethane and ethylene glycol m-tolyl ether in the heat-sensitive recording material or the heat-sensitive recording layer being in the range from 4:1 to 1.2:1.

Preference is given to a use according to one aspect of the invention, wherein the fatty acid amide used having a number of carbon atoms in the range from 16 to 24 or the mixture of plural fatty acid amides used each having a number of carbon atoms in the range from 16 to 24, preferably octadecanamide and/or N-(hydroxymethyl)octadecanamide, remains in the solid state during the thermal printing operation. It therefore does not melt and so also does not act as a sensitizer. One aspect of the invention, moreover, achieves other of the specified objects by a method of producing a heat-sensitive recording material of an aspect of the invention (as defined above and below, and in the claims), having the following steps:

providing or producing a carrier substrate with interlayer disposed thereon and also a coating composition of the invention (as defined above and below, and in the claims), applying the coating composition to the interlayer, drying the applied coating composition, to give a heat-sensitive recording layer which is present together with the carrier substrate and the interlayer in the heat-sensitive recording material.

The compound having the formula (I) is already known and is disclosed for example in EP 2 923 851 A1 or the aforementioned DE 10 2014 107 567 B3. It corresponds to the compound already identified in the text above as NKK.

One aspect of the invention is based on the surprising experimental finding that a coating composition for producing a heat-sensitive recording material, or a corresponding heat-sensitive recording layer, which as color developer comprises a compound of formula (I)

(I)

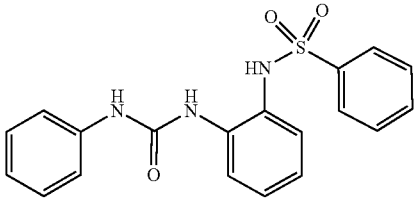

(that is NKK, i.e., N-[2-(3-phenylureido)phenyl]-benzenesulfonamide)

and further comprises one or plural dye precursors, possesses a particularly and unexpectedly high grease resistance if the coating composition or the heat-sensitive recording layer comprise at the same time one or more fatty acid amides each having a number of carbon atoms in the range from 16 to 24 and as sensitizer, one or more compounds selected from the group consisting of 1,2-diphenoxyethane (DPE) and ethylene glycol m-tolyl ether (EGTE), and preferably the ratio of the total mass of fatty acid amides having a number of carbon atoms in the range from 16 to 24 to the total mass of compounds selected from the group consisting of 1,2-diphenoxyethane and ethylene glycol m-tolyl ether in the coating composition or the heat-sensitive recording layer is in the range from 4:1 to 1.2:1.

The increased grease resistance here can presumably be attributed to a synergistic effect between fatty acid amide and the sensitizer used. At least, in experimental studies in house, it has emerged that in coating compositions of the invention comprising either octadecanamide (stearamide) or N-(hydroxymethyl)octadecanamide and also, as sensitizer, either 1,2-diphenoxyethane (DPE) or ethylene glycol m-tolyl ether (EGTE), the total mass of octadecanamide or N-(hydroxymethyl)octadecanamide and DPE or EGTE being kept constant in each case but the mass ratio varied, the grease resistance ascertained experimentally in each case was not merely attributable additively to the performance of the individual octadecanamide or N-(hydroxymethyl)octadecanamide and DPE or EGTE constituents. Surprisingly, instead, it emerged that the grease resistance in the mixtures was superadditive. In-house studies on the grease resistance were carried out according to a test method which is specified below under the heading "Determining the resistance of heat-sensitive recording materials to lanolin".

Commercially available lanolin (as used in the in-house studies on grease resistance) constitutes a mixture which is obtained by melting together 65 mass fractions of woolwax, 20 mass fractions of water, and 15 mass fractions of low-viscosity paraffin. Woolwax (wool grease, adeps lanae, INCI designation: lanolin, E 913) is the secretion of the sebaceous glands of the sheep. It is got by extraction of ovine fleeces with isopropanol. The name lanolin derives from the Latin lana for wool and oleum for oil.

In the present text—as in a great many documents from the prior art—a series of designations, synonymous with one another and identical in content, are used for substances that are the same in each case. Set out below for a series of a total of six substances or substance classes are those synonymous designations which are used in the context of the present text and in documents from the prior art.

1. The compound of the formula (I)

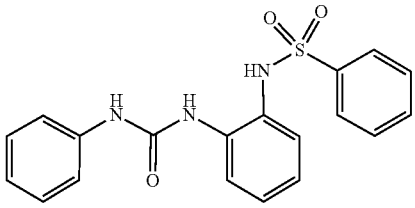

is identified in the present text as NKK or as N-[2-(3-phenylureido)phenyl]benzenesulfonamide; the same compound is identified in DE 10 2014 107 567 B3 likewise as N-[2-(3-phenylureido)phenyl]benzenesulfonamide, and as phenylureidophenylbenzenesulfonamide. In the as yet unpublished application PCT/EP2017/074875, the designations N-{2-[(phenylcarbamoyl)amino]phenyl}benzenesulfonamide and N-[2-(3-phenylureido)phenyl]-benzenesulfonamide are used for the same substance. Compounds with the CAS number 215917-77-4 and the EC No. 806-543-7 are also identified as NKK.

2. Ethylene glycol m-tolyl ether is also identified as EGTE in the present text; the same compound is identified in DE 10 2014 107 567 B3 as 1,2-di(3-methylphenoxy)ethane. The application PCT/EP2017/074875 for this same substance uses the designations 1,2-di(m-methylphenoxy) ethane and 1,2-bis(3-methylphenoxy)ethane. The compound with the CAS number 54914-85-1 is also identified as ethylene glycol m-tolyl ether.

3. Octadecanamide is identified in DE 10 2014 107 567 B3 as stearamide or as stearic acid amide. The application PCT/EP2017/074875 likewise uses the designation stearamide for the same substance. The compound with the CAS number 124-26-5 is also identified as octadecanamide.

4. Benzyl 2-naphthyl ether is also identified in the present text as benzyl naphthyl ether; the same compound is identified in DE 10 2014 107 567 B3 as 2-benzyloxynaphthalene. The compound with the CAS number 613-62-7 is also identified as benzyl 2-naphthyl ether.

5. The substance class of the dye precursors is referred to in DE 10 2014 107 567 B3 as color formers. The application PCT/EP2017/074875 uses the designation dye precursors and also the designation color formers for the same substance class.

6. The substance class of the sensitizers is referred to in DE 10 2014 107 567 B3 as sensitizing agents.

In the aforementioned document DE 10 2014 107 567 B3 there are no indications that the fatty acid amide employed therein, stearamide (octadecanamide), might interact synergistically with one or more of the further sensitizing agents (sensitizers) specified in said document. In light of this fact, the technical effects achievable with the present invention and the findings on which the invention is based are particularly surprising.

A coating composition of the invention or a heat-sensitive recording layer of one aspect of the invention (as defined above and in the claims) preferably comprises one or more constituents from the group consisting of further sensitizers,
pigments,
dispersants,
antioxidants,
release agents,
defoamers,
light stabilizers,
and
brighteners.

A coating composition of one aspect of the invention or heat-sensitive recording layer of one aspect of the invention comprises in every case a sensitizer, namely in accordance with one aspect of the invention at least one or plural compounds from the group comprising 1,2-diphenoxyethane (DPE) and ethylene glycol m-tolyl ether (EGTE). The one or plural fatty acid amides present in accordance with one aspect of the invention and each having a number of carbon atoms in the range from 16 to 24 are likewise understood by many experts to be sensitizers. In addition, however, there are preferably one or plural further sensitizers present.

A sensitizer in a heat-sensitive recording layer is first melted during the supply of heat during the printing operation, and the melted sensitizer dissolves the color formers and color developers present alongside one another and/or lowers the melting temperature of the color formers and color developers, to bring about a color development reaction. The sensitizer itself does not take part in the color development reaction.

A "further sensitizer" comprehends substances which (likewise) serve for adjusting the melting temperature (color development temperature) of the heat-sensitive recording layer and with which it is possible preferably to set a melting temperature of <100° C., preferably in the range from around 70 to 80° C., without the sensitizers themselves participating in the color development reaction.

Employed preferably as further sensitizers are, for example, fatty acid salts, fatty acid esters, and fatty acid amides (e.g., zinc stearate, palmitamide, oleamide, lauramide, ethylene- and methylenebisstearamide, methylolstearamide), naphthalene derivatives, biphenyl derivatives, and phthalates and terephthalates.

Particularly preferred is a coating composition of one aspect of the invention or a heat-sensitive recording layer of one aspect of the invention, wherein the further sensitizer is selected from the group consisting of 2-(2H-benzotriazol-2-yl)-p-cresol, 2,2'-bis(4-methoxyphenoxy)diethyl ether, 4,4'-diallyloxydiphenyl sulfone, 4-acetylacetophenone, 4-benzylbiphenyl, acetoacetanilide, benzyl 2-naphthyl ether, benzyl naphthyl ether, benzyl 4-(benzyloxy)benzoate, benzyl paraben, bis(4-chlorobenzyl) oxalate ester, bis(4-methoxyphenyl) ether, dibenzyl oxalate, dibenzyl terephthalate, dimethyl terephthalate, dimethyl sulfone, diphenyl adipate, diphenyl sulfone, ethylenebisstearamide, fatty acid anilides, m-terpenyl, N-methylolstearamide, N-stearylurea, N-stearylstearamide, p-benzylbiphenyl, phenyl benzenesulfonate ester, salicylanilide, and α,α'-diphenoxyxylene, particular preference being given to benzyl naphthyl ether and diphenyl sulfone.

Likewise preferred as further sensitizers for use in a coating composition of one aspect of the invention or in a heat-sensitive recording layer of one aspect of the invention are the sensitizers disclosed in paragraphs [0059] to [0061] of EP 2 923 851 A1. Particularly preferred is the use of one or plural further sensitizers, wherein the respective sensitizer has a melting point in the range from 60° C. to 140° C., preferably a melting point in the range from 60° C. to 100° C.

As well as sensitizers, a coating composition of one aspect of the invention or a heat-sensitive recording layer of one aspect of the invention preferably also comprises one or more constituents from the group consisting of pigments, dispersants, antioxidants, release agents, defoamers, light stabilizers, and brighteners. Each of these components is used preferably in an amount with a mass fraction of 0.01 to 15%, more particularly—except for defoamer—0.1 to 15%, preferably 1 to 10%, based on the total solids fraction of the coating composition of the invention or of the heat-sensitive recording layer. When defoamer is used in a coating composition of one aspect of the invention or a heat-sensitive recording layer of the invention, the defoamer is present preferably in amounts with a mass fraction of 0.03 to 0.05%, based on the total solids fraction of the coating composition of the invention or of the heat-sensitive recording layer of one aspect of the invention.

A heat-sensitive recording layer of one aspect of the invention can of course be shielded by the disposition of a concealing protective layer in such a way as to afford protection against external influences. The disposition of such a protective layer, however, is generally unnecessary in the context of one aspect of the present invention and hence also not preferred. Because of the selection and combination of fatty acid amides each having a number of carbon atoms in the range from 16 to 24 with a sensitizer from the group consisting of DPE and EGTE, indeed, the coating composition of one aspect of the invention and the heat-sensitive recording layer of one aspect of the invention are already equipped in such a way as to afford a thermal printout on a heat-sensitive recording layer of one aspect of the invention, which, indeed, may in particular be a constituent of a heat-sensitive recording material of the invention, with outstanding resistance to substances selected from the group consisting of water, alcohols, fats, oils, and mixtures thereof, and particularly with resistance to fats and oils, even without a protective layer.

A coating composition of one aspect of the invention or a heat-sensitive recording layer of the invention comprises a compound of the formula (I) (that is, NKK). A compound of the formula (I) is already known and is described for example in EP 2 923 851 A1. It has emerged, however, that the compound of the formula (I) may be present in two different crystalline forms. The two crystalline forms have different physical properties, which may have effects on the properties of the coating composition of one aspect of the invention, of the heat-sensitive recording layer of one aspect of the invention, and of the heat-sensitive recording material of one aspect of the invention.

A first crystalline form of the compounds with the formula (I) has a melting point of around 158° C., whereas a second crystalline form of the compounds with the formula (I) has a melting point of 175° C. In connection with heat-sensitive recording materials, the only description in the literature to date has been of the compound with the formula (I) which is the crystalline form having a melting point of around 158° C. (cf., for example, EP 2 923 851 A1 paragraph [0084]). Neither the preparation nor the use of the crystalline form of the compounds with the formula (I) having a melting point of around 175° C., as used in accordance with one aspect of the invention, have been described in the literature published to date; cf., however, the application PCT/EP2017/074875. It must therefore be assumed that in accordance with the published prior art, the crystalline form of the compound with the formula (I) having a melting point of around 158° C. has always been used, even if the melting point is not explicitly mentioned in the corresponding document. The crystalline form of the compound of the formula (I) having a melting point of 175° C., as used in accordance with the invention, has recently become available commercially as well.

Preferred in accordance with one aspect of the invention, therefore, are a coating composition of the invention, a heat-sensitive recording layer of the invention, and a heat-sensitive recording material of the invention, wherein the crystalline form of the compound of the formula (I) exhibits a (preferably endothermic) transition at a temperature between 170° C. and 178° C., preferably between 173° C. and 177° C., more preferably between 174° C. and 176° C., determined by means of differential scanning calorimetry (DSC) at a heating rate of 10 K/min.

Both crystalline forms of the compounds having the formula (I) may likewise be distinguished from one another in the IR absorption spectrum. Particularly characteristic in the case of the crystalline form of the compounds having the formula (I), used in accordance with the invention, is an absorption band in the IR spectrum at 3401±20 $cm^{-1}$. In the case of the crystalline form of the compounds having the formula (I) that has a melting point of around 158° C., this band is absent, there being instead a band at each of 3322 and 3229 $cm^{-1}$.

Preferred in accordance with one aspect of the invention is a heat-sensitive recording material, wherein the crystalline form of the compound of the formula (I) in the IR spectrum has absorption bands at 689±10 $cm^{-1}$, 731±10 $cm^{-1}$, 1653±10 $cm^{-1}$, 3364±20 $cm^{-1}$, and 3401±20 $cm^{-1}$.

Preferred in accordance with one aspect of the invention are a coating composition of the invention, a heat-sensitive recording layer of the invention, and, respectively, a heat-sensitive recording material of the invention, wherein the IR absorption spectrum of the crystalline form of the compound of the formula (I) coincides substantially with the IR absorption spectrum depicted in FIG. 1*a*), 2*a*) and/or 3*a*).

The two crystalline forms of the compounds having the formula (I) may likewise be distinguished from one another in the X-ray powder diffractogram. Preferred in accordance with one aspect of the invention are a coating composition of the invention, a heat-sensitive recording layer of the invention, and a heat-sensitive recording material of the invention, wherein the crystalline form of the compound of the formula (I) has an X-ray powder diffractogram having diffraction reflections at °2θ values of 10.00±0.20, 11.00±0.20, 12.40±0.20, 13.80±0.20, and 15.00±0.20.

Preferred in accordance with one aspect of the invention are a coating composition of the invention, a heat-sensitive recording layer of the invention, and a heat-sensitive recording material of the invention, wherein the crystalline form of the compound of the formula (I) has an X-ray powder diffractogram which substantially coincides with the X-ray powder diffractogram depicted in FIG. 4*b*).

In-house studies worked predominantly with a crystalline form of the compound of the formula (I) that in the IR spectrum has an absorption band at 3401±20 $cm^{-1}$ and/or has a melting point of 175° C. and/or has a transition at a temperature between 170° C. and 178° C., determined by differential scanning calorimetry (DSC) at a heating rate of 10 K/min, and/or in the X-ray powder diffractogram has diffraction reflections at °2θ values of at least 10.00±0.20, 11.00±0.20, 12.40±0.20, 13.80±0.20, and 15.00±0.20. The use of such a compound of the formula (I) is somewhat preferred for all aspects of the present invention. A coating composition of one aspect of the invention and also a heat-sensitive recording layer of the invention preferably comprise pigments. The pigments may be organic pigments, inorganic pigments, or a mixture of organic pigments and inorganic pigments.

A coating composition of one aspect of the invention or a heat-sensitive recording layer of the invention (as defined above, preferably as identified above as being preferred) is preferred, wherein said one or one of the plural fatty acid amides having a number of carbon atoms in the range from 16 to 24 is octadecanamide (stearamide; stearic acid amide). Octadecanamide is chemically compatible with the compound of the formula (I) (NKK) and with sensitizers from the group consisting of 1,2-diphenoxyethane (DPE) and ethylene glycol m-tolyl ether (EGTE). As the pure substance, octadecanamide possesses a melting point of 109° C. and it is therefore an outstanding sensitizer (cf. the corresponding use according to DE 10 2014 107 567 B3); it does not itself participate in the color development reaction. The capacity of octadecanamide (and other fatty acid amides having a number of carbon atoms in the range from 16 to 24) for synergistic interactions with DPE and/or EGTE was hitherto unknown from the prior art. Likewise preferred is the use of N-(hydroxymethyl)octadecanamide as fatty acid amide.

Preference is given to a coating composition of one aspect of the invention and to a heat-sensitive recording layer of one aspect of the invention, wherein octadecanamide or N-(hydroxymethyl)octadecanamide is used in combination with DPE and/or EGTE in such a way that the color reaction can take place at an exposure temperature (color development temperature) of as low as 100° C. Because octadecanamide possesses a melting point of 109° C. or N-(hydroxymethyl)octadecanamide possesses a melting point of >107° C. but EGTE possesses a melting point in the range from 96 to 100° C. and diphenoxyethane a melting point in the range from 94 to 96° C., the actual sensitizing performance in recording layers or coating compositions of the invention formulated in this way is primarily attributable to the presence of DPE or EGTE. The primary function of the octadecanamide in such a formulation, therefore, is of achieving and/or ensuring the desired grease resistance through synergistic interaction with DPE and/or EGTE. The desired grease resistance is achieved and/or ensured analogously, in a further configuration according to the invention, through synergistic interaction of N-(hydroxymethyl)octadecanamide with DPE and/or EGTE.

In a preferred coating composition of one aspect of the invention or heat-sensitive recording layer of one aspect of the invention, the ratio of the mass of the compound of the formula (I) to the total mass of fatty acid amides having a number of carbon atoms in the range from 16 to 24 (preferably octadecanamide) in the coating composition or the heat-sensitive recording layer is in the range from 1.2:1 to 4:1. In preferred embodiments, therefore, the mass of NKK used is at least slightly predominant (1.2:1) in comparison with the total mass of fatty acid amides used. Too great an excess of NKK (mass ratio greater than 4:1) is no longer advantageous, since in that case the positive properties and effects of the fatty acid amide (preferably octadecanamide) are no longer manifested in the desired way.

As already observed, a preferred coating composition or heat-sensitive recording layer of one aspect of the invention comprises octadecanamide (as the one or as one of plural fatty acid amides each having a number of carbon atoms in the range from 16 to 24). In preferred coating compositions or heat-sensitive recording layers of this kind, the ratio of the mass of the compound of formula (I) (NKK) to the mass of octadecanamide in the coating composition or the heat-sensitive recording layer is in the range from 1.2:1 to 4:1.

A preferred coating composition of one aspect of the invention or a heat-sensitive recording layer of one aspect of the invention, as defined above, preferably as defined above as being preferred, is characterized in that the ratio of the total mass of fatty acid amides having a number of 16 to 24 to the total mass of compounds selected from the group consisting of 1,2-diphenoxyethane (DPE) and ethylene glycol m-tolyl ether (EGTE) in the coating composition or the heat-sensitive recording layer is in the range from 4:1 to 1.2:1, preferably in the range from 1.5:1 to 1.2:1. Such ratios of the total amount of fatty acid amides having a number of carbon atoms in the range from 16 to 24 to the total mass of compounds selected from the group consisting of DPE and EGTE are particularly preferred since at the same time this achieves particularly high grease resistance and a low color development temperature. A low color development temperature is advantageous since no unduly large quantities of energy are needed in order to generate a color change. A high grease resistance increases the practical benefit and means that there are certain utilities for which such heat-sensitive recording materials become suitable at all. The fatty acid amides (preferably octadecanamide and/or N-(hydroxymethyl)octadecanamide) and DPE and/or EGTE interact synergistically, and so the required amount of fatty acid amides (preferably: octadecanamide) needed to achieve a stipulated grease resistance is comparatively low, in comparison with a situation where neither DPE nor EGTE is present. This dependency relationship between the parameters of grease resistance and color development temperature, which are critical for the practical benefit, and the mixing ratio of the fatty acid amide (preferably octadecanamide and/or N-(hydroxymethyl)octadecanamide) and also DPE and/or EGTE constituents is surprising in light of the prior art. If, in a coating composition of one aspect of the invention or a corresponding heat-sensitive recording layer, the total mass of fatty acid amides having a number of carbon atoms in the range from 16 to 24 to the total mass of DPE and/or EGTE that is chosen is too large, meaning a ratio of >4, for example, then it is no longer ensured in every case that the color development temperature is as low as desired. If, alternatively, too low a ratio is chosen, then it is no longer guaranteed in each individual case that the grease resistance will meet the requirements.

Particular preference is given to a coating composition of one aspect of the invention or a heat-sensitive recording layer of one aspect of the invention as defined above (preferably as identified above as being preferred), comprising one or plural color developers, said one or at least one of the plural color developers being a compound of the formula (I)

(I)

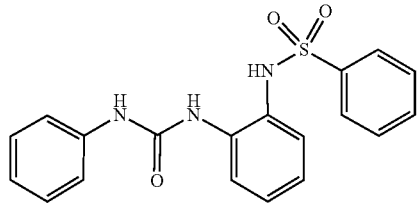

, one or plural dye precursors, octadecanamide and/or N-(hydroxymethyl)octadecanamide, as sensitizer, 1,2-diphenoxyethane (DPE) and/or ethylene glycol m-tolyl ether (EGTE), the ratio of the mass of the compound of the formula (I) to the mass of octadecanamide in the coating composition or the heat-sensitive recording layer being in the range from 1.2:1 to 4:1, and the ratio of the total mass of octadecanamide and N-(hydroxymethyl)octadecanamide to the total mass of 1,2-diphenoxyethane (DPE) and ethylene glycol m-tolyl ether (EGTE)

in the coating composition or the heat-sensitive recording layer being in the range from 1.5:1 to 1.2:1.

A coating composition of one aspect of the invention of this kind or a heat-sensitive recording layer of one aspect of the invention of this kind unites advantages discussed above and is therefore, in particular, particularly grease resistant and has a comparatively low color development temperature, without any need for particularly high quantities of octadecanamide and/or N-(hydroxymethyl)octadecanamide in order to achieve the grease resistance.

A coating composition of one aspect of the invention or a heat-sensitive recording layer of one aspect of the invention (as defined above, preferably as identified above as being preferred) preferably comprises as sensitizer 1,2-diphenoxyethane (DPE) or a mixture of 1,2-diphenoxyethane (DPE) and ethylene glycol m-tolyl ether (EGTE). In such preferred coating compositions and heat-sensitive recording layers, therefore, DPE is present. With regard to preferred proportions, reference may be made to the observations above.

Preference is given to a coating composition of one aspect of the invention or a heat-sensitive recording layer of one aspect of the invention as defined above (preferably as identified above as being preferred), comprising, based on the oven-dry state, 8 to 30 percentage mass fractions (mass fractions expressed in %) of a total amount of one or plural color developers, said one or at least one of the plural color developers being a compound of the formula (I)

(I)

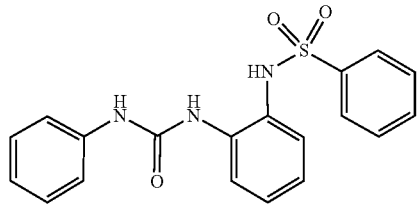

, preferably 8 to 30 percentage mass fractions of the color developer of the formula (I), based in each case on the total amount of the coating composition in the oven-dry state or of the heat-sensitive recording layer in the oven-dry state and/or 4 to 16 percentage mass fractions of a total amount of one or plural dye precursors, based on the total amount of the coating composition in the oven-dry state or of the heat-sensitive recording layer in the oven-dry state and/or 2.4 to 34 percentage mass fractions of a total amount of one or plural fatty acid amides each having a number of carbon atoms in the range from 16 to 24, preferably 2.4 to 34 percentage mass fractions of a total amount of one or more compounds selected from the group consisting of octadecanamide and N-(hydroxymethyl)octadecanamide, more preferably 2.4 to 34 percentage mass fractions of octadecanamide, based in each case on the total amount of the coating composition in the oven-dry state or of the heat-sensitive recording layer in the oven-dry state and/or as sensitizer, 2 to 8.5 percentage mass fractions of a total amount of one or more compounds selected from the group consisting of 1,2-diphenoxyethane and ethylene glycol m-tolyl ether, preferably 2 to 8.5 percentage mass fractions of 1,2-diphenoxyethane or 2 to 8.5 percentage mass fractions of a mixture of 1,2-diphenoxyethane and ethylene glycol m-tolyl ether, based in each case on the total amount of the coating composition in the oven-dry state or of the heat-sensitive recording layer in the oven-dry state and/or 6 to 24 percentage mass fractions of a total amount of one or plural binders, preferably 6 to 24 percentage mass fractions of polyvinyl alcohol (PVA) (as particularly preferred binder), based in each case on the total amount of the coating composition in the oven-dry state or of the heat-sensitive recording layer in the oven-dry state and/or 25 to 55 percentage mass fractions of a total amount of one or plural pigments, based on the total amount of the coating composition in the oven-dry state or of the heat-sensitive recording layer in the oven-dry state.

Particular preference is therefore given (in accordance with observations above) to a coating composition of the invention or a heat-sensitive recording layer of one aspect of the invention as defined above (preferably as identified above as being preferred), comprising, based on the oven-dry state, 8 to 30 percentage mass fractions of a total amount of one or plural color developers, said one or at least one of the plural color developers being a compound of the formula (I), (I)

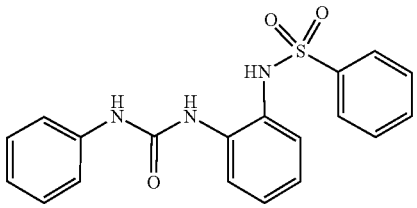

preferably 8 to 30 percentage mass fractions of the color developer of the formula (I), based in each case on the total amount of the coating composition in the oven-dry state or of the heat-sensitive recording layer in the oven-dry state, 4 to 16 percentage mass fractions of a total amount of one or plural dye precursors, based on the total amount of the coating composition in the oven-dry state or of the heat-sensitive recording layer in the oven-dry state, 2.4 to 34 percentage mass fractions of a total amount of one or plural fatty acid amides each having a number of carbon atoms in the range from 16 to 24, preferably 2.4 to 34 percentage mass fractions of a total amount of one or more compounds selected from the group consisting of octadecanamide and N-(hydroxymethyl)octadecanamide, more preferably 2.4 to 34 percentage mass fractions of octadecanamide, based in each case on the total amount of the coating composition in the oven-dry state or of the heat-sensitive recording layer in the oven-dry state, as sensitizer, 2 to 8.5 percentage mass fractions of a total amount of one or more compounds selected from the group consisting of 1,2-diphenoxyethane and ethylene glycol m-tolyl ether, preferably 2 to 8.5 percentage mass fractions of 1,2-diphenoxyethane or 2 to 8.5 percentage mass fractions of a mixture of 1,2-diphenoxyethane and ethylene glycol m-tolyl ether, based in each case on the total amount of the coating composition in the oven-dry state or of the heat-sensitive recording layer in the oven-dry state, 6 to 24 percentage mass fractions of a total amount of one or plural binders, preferably 6 to 24 percentage mass fractions of polyvinyl alcohol (PVA), based in each case on the total amount of the coating composition in the oven-dry state or of the heat-sensitive recording layer in the oven-dry state, and 25 to 55 percentage mass fractions of a total amount of one or plural pigments, based on the total amount of the coating composition in the oven-dry state or of the heat-sensitive recording layer in the oven-dry state with the proviso that for this particularly preferred coating composition or heat-sensitive recording layer, the ratio of the total mass of fatty acid amides having a number of carbon atoms in the range from 16 to 24 to the total mass of compounds selected from the group consisting of 1,2-diphenoxyethane and ethylene glycol m-tolyl ether in the coating composition or the heat-sensitive recording layer is preferably in the range from 4:1 to 1.2:1. Analogous provisos apply preferably for embodiments of such a particularly preferred coating composition or heat-sensitive recording layer that result from combination with preferred embodiments and/or features as defined above or below in the appended claims.

It may be noted that the indications "based on the oven-dry state" and "in the oven-dry state" specify that the stated mass fractions of coating composition or heat-sensitive recording layer, respectively, relate to a measurement carried out on oven-dry material. The statements do not, however, mean that only oven-dry materials are defined; instead, a coating composition or a heat-sensitive recording layer also falls within the respective definition, for example, when it contains considerable amounts of liquid (e.g., water), provided that, after oven drying, a corresponding measurement results in total amounts of the relevant constituents that do fall within the respectively indicated ranges.

It is preferred in the invention if the heat-sensitive recording layer has a Bekk smoothness, determined according to DIN 53107:2016-05 (title: Testing of paper and board—Determination of the smoothness by the Bekk method), of 100 to 1200 seconds, preferably of 150 to 1100 seconds.

As already observed above, one aspect of the invention also relates to a heat-sensitive recording material comprising a carrier substrate and a heat-sensitive recording layer of the invention. In a heat-sensitive recording material of the invention of this kind there are preferably one or plural interlayers disposed between carrier substrate and heat-sensitive recording layer. An interlayer of this kind preferably comprises pigments. The pigments may be organic pigments, inorganic pigments, or a mixture of organic pigments and inorganic pigments.

It is preferred in the invention if the surface mass of the interlayer is in the range from 5 to 20 g/m$^2$, preferably in the range from 7 to 12 g/m$^2$.

Where the interlayer comprises pigments, it is preferred in one aspect of the invention if the pigments are organic pigments, preferably organic hollow-body pigments.

In-house studies have shown the incorporation of organic pigments into the interlayer to be advantageous, because organic pigments exhibit high heat reflection capacity. Through increased heat reflection of the interlayer embodied with organic pigments, the response characteristics of the heat-sensitive recording layer with respect to heat are heightened, because the irradiated heat is reflected at least partly into the heat-sensitive recording layer, instead of being conducted to the carrier substrate. As a result, the sensitivity and the dissolution capacity of the heat-sensitive recording material are significantly increased and, furthermore, the printing speed in the thermal printer is boosted. Moreover, the energy consumption during the printing operation can be lowered, which is an advantage particularly in the case of mobile devices. Hollow-body pigments have air in their interior, and consequently they typically exhibit even greater heat reflection, and the sensitivity and the dissolution capacity of the heat-sensitive recording material can be increased further still.

Where the interlayer comprises pigments, it is preferred in an alternative embodiment of the invention if the pigments are inorganic pigments, preferably selected from the list consisting of calcined kaolin, silicon oxide, bentonite, calcium carbonate, aluminum oxide and boehmite.

Where inorganic pigments are incorporated into the interlayer situated between the recording layer and the substrate, these pigments are able, during formation of the written image, to accommodate the constituents of the heat-sensitive recording layer that have been liquefied by exposure to heat from the thermal head, and consequently they promote even more reliable and more rapid functioning of the heat-induced recording.

It is particularly advantageous if the inorganic pigments of the interlayer have an oil absorption value of at least 80 cm$^3$/100 g and even better of 100 cm$^3$/100 g, determined according to DIN EN ISO 787-5:1995-10 (title: General methods of test for pigments and extenders—Part 5: Determination of oil absorption value (ISO 787-5:1980); German version EN ISO 787-5:1995). On the basis of its high absorption reservoir in the hollow spaces, calcined kaolin has proven particularly suitable. Mixtures of plural inorganic pigments of different kinds may also be contemplated.

The choice of the proportion of organic to inorganic pigments produces a combination of the effects brought about by the two types of pigment. It is particularly advantageous if the pigment mixture consists of organic pigment with a mass fraction of 5 to 30% or, better still, at 8 to 20%, and of inorganic pigment at 95 to 70% or, better still, at 92 to 80%. Pigment mixtures of different organic pigments and/or inorganic pigments are advantageous in specific cases.

Preferred in one aspect of the invention is a heat-sensitive recording material, wherein the interlayer, optionally in addition to the inorganic and/or organic pigments, comprises at least one binder, preferably based on a synthetic polymer, with styrene-butadiene latex affording particularly good results. Polyvinyl alcohol (PVA) represents a further preferred binder. The use of a synthetic binder with admixture of at least one natural polymer, such as starch with particular preference, represents a particularly suitable embodiment of an interlayer. In the course of experiments with inorganic pigments it was also found that a binder-pigment ratio within the interlayer of between 3:7 and 1:9, based in each case on the percentage mass fraction in the interlayer, represents a particularly suitable embodiment.

Preference is given to a heat-sensitive recording material of one aspect of the invention, wherein no further layer is disposed on the side of the heat-sensitive recording layer that is facing away from the carrier substrate. In particular, therefore, the heat-sensitive recording layer of the heat-sensitive recording material of the invention does not carry a top coat. Such a top coat, though possible, is nevertheless not preferable, in particular because the heat-sensitive recording layer as set out above possesses particularly high grease resistance and consequently there is no longer any need for a top coat in order to bring about this quality.

Preference is given to a heat-sensitive recording material of one aspect of the invention, preferably a recording material of the invention as identified above as being preferred, wherein the carrier substrate consists of paper, synthetic paper, polymeric film, or an assembly of these materials. The technical effects associated with the present invention are largely independent of the carrier substrate, and so said substrate can be selected from a broad group of materials.

A particularly preferred carrier substrate, however, is a coating base paper which has not been surface-treated, since such a paper exhibits high recyclability and high environmental compatibility. A coating base paper which has not been surface-treated means a coating base paper which has not been treated in a sizing press or in a coating apparatus. Preferred polymeric films are films of polypropylene or other polyolefins. Also preferred in the invention are papers coated with one or more polyolefins (especially polypropylene).

In one especially preferred variant embodiment, the carrier substrate is a paper with a mass fraction of recycled fibers of at least 70%, based on the total pulp fraction in the paper.

A coating composition of one aspect of the invention and also a heat-sensitive recording layer of the invention each comprise one or more dye precursors (color formers). The use of color formers which are compounds of the fluoran type is preferred, preference being given to compounds selected from the group consisting of 3-diethylamino-6-methyl-7-anilinofluoran, 3-diethylamino-6-methyl-7-(3'-methylphenyl-amino)fluoran (6'-(diethylamino)-3'-methyl-2'-(m-tolylamino)-3H-spiro [isobenzofuran-1,9'-xanthen]-3-one; ODB-7), 3-di-n-pentylamino-6-methyl-7-anilinofluoran, 3-(diethylamino)-6-methyl-7-(3-methylphenylamino)fluoran, 3-di-n-butylamino-7-(2-chloroanilino)fluoran, 3-diethylamino-7-(2-chloroanilino)fluoran, 3-diethylamino-6-methyl-7-xylidinofluoran, 3-diethylamino-7-(2-carbomethoxyphenylamino)fluoran, 3-pyrrolidino-6-methyl-7-anilinofluoran, 3-pyrrolidino-6-methyl-7-(4-n-butyl-phenylamino)fluoran, 3-piperidino-6-methyl-7-anilinofluoran, 3-N-n-dibutylamine-6-methyl-7-anilinofluoran (ODB-2), 3-(N-methyl-N-cyclohexyl)amino-6-methyl-7-anilinofluoran, 3-(N-methyl-N-propyl)amino-6-methyl-7-anilinofluoran, 3-(N-methyl-N-tetrahydrofurfuryl)amino-6-methyl-7-anilinofluoran), 3-(N-ethyl-N-isoamyl)amino-6-methyl-7-anilinofluoran, 3-(N-ethyl-N-tolyl)amino-6-methyl-7-anilinofluoran, 3-(N-ethyl-N-tetrahydrofuryl)amino-6-methyl-7-anilinofluoran, 3-(N-ethyl-N-isopentylamino)-6-methyl-7-anilinofluoran, 3-(N-ethyl-4-toluidino)-6-methyl-7-(4-toluidino)-fluoran, and 3-(N-cyclopentyl-N-ethyl)amino-6-methyl-7-anilinofluoran.

Likewise preferred are coating compositions or heat-sensitive recording layers of the invention which as dye precursors (color formers) comprise the compounds stated in paragraphs [0049] to [0052] of EP 2 923 851 A1.

Particularly preferred in one aspect of the invention is a coating composition of the invention, and a heat-sensitive recording layer of the invention, which use a dye precursor (color former) selected from the group consisting of 3-N-di-n-butylamine-6-methyl-7-anilinofluoran (ODB-2) and 3-(N-ethyl-N-isopentylamino)-6-methyl-7-anilinofluoran.

A coating composition of the invention and a heat-sensitive recording layer of the invention comprise one or plural color developers, said one or at least one of the plural color developers being NKK. Besides NKK there may be one or plural further color developers present, resulting overall in a color developer mixture. Preference is given to a coating composition of the invention and a heat-sensitive recording layer of the invention for which, in addition to a compound of the formula (I) (NKK) as first color developer, there is a further color developer which is a compound of the formula (II)

(II)

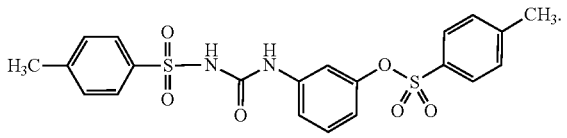

The compound of the formula (I) (NKK) is present preferably (but not necessarily) in a crystalline form, as already described above, which in the IR spectrum has an absorption band at 3401±20 $cm^{-1}$.

The compound of the formula (II) is the compound N-(4-methylphenylsulfonyl)-N'-(3-(4-methylphenylsulfonyloxy)phenyl)urea, which is already known, is sold under the name Pergafast® 201, and described for example in EP 1 140 515 B1. Pergafast® 201 is the most frequently used phenol-free color developer.

Surprisingly, the simultaneous presence of the compound of the formula (II) alongside the compound of the formula (I) (NKK) makes a further contribution to achieving a further increase in the grease resistance of a heat-sensitive recording layer of the invention and, respectively, of a corresponding heat-sensitive recording material of the invention. In relation to the resistance toward grease, a synergistic effect has been observed, which results when the compounds of the formula (I) and (II) are present simultaneously. Preferably, in coating compositions, heat-sensitive recording layers, and heat-sensitive recording materials of the invention, there is a mass ratio between the compound of the formula (I) and the compound of the formula (II) of 0.5:99.5 to 99.5:0.5. In-house studies have shown that for a mass fraction of less than 0.5% of the compound with the formula (I) or (II), based on the total mass of the compounds with the formula (I) and (II), the positive influence of the respective compound is not so greatly pronounced.

Particularly preferred in the invention are a coating composition of the invention, a heat-sensitive recording layer of the invention and also a heat-sensitive recording material of the invention, wherein the mass ratio between the compound of the formula (I) and the compound of the formula (II) is 35:65 to 65:35, preferably 40:60 to 60:40, more preferably 45:55 to 55:45.

Such mixtures produce a (further) synergistic effect in relation to improved resistance toward lanolin, and also, moreover, an improved long-term stability.

As already observed above, certain objects forming a basis for one aspect of the present invention are achieved through the use of a fatty acid amide (as defined above and in the claims). For this use according to the invention, all of the observations made above regarding (preferred) coating compositions, heat-sensitive recording layers, and heat-sensitive recording materials of the invention are valid correspondingly, mutatis mutandis.

It has already been observed earlier on above that the invention achieves certain of the objects forming a basis for the present invention also through a method for producing a heat-sensitive recording material of the invention (as defined there and in the claims). In this respect as well, the observations above regarding (preferred) coating compositions, heat-sensitive recording layers, and heat-sensitive recording materials of the invention are valid correspondingly, mutatis mutandis.

In a method of one aspect of the invention, the coating composition is preferably applied in an amount of 2.2 to 2.6 $g/m^2$ to the carrier substrate or to an interlayer disposed thereon. A coatweight of this kind is comparatively low by comparison with coating compositions from the prior art which are intended likewise to possess high grease resistance. In the context of the present invention it is possible to achieve a high grease resistance with such a low coatweight for the reason that, owing to the synergistic interaction between the fatty acid amide having a number of carbon atoms in the range from 16 to 24 (preferably octadecanamide and/or N-(hydroxymethyl)octadecanamide) and the DPE and/or EGTE sensitizers, there is no need to use a large quantity of fatty acid amide which increases the grease resistance.

Preferred is a method of one aspect of the invention (as defined above and/or in the claims) for producing a heat-sensitive recording material (of one aspect of the invention), having the following steps:

providing or producing
- a carrier substrate with interlayer disposed thereon (in each case preferably as described above as being preferred)

and also
- a coating composition of the invention, applying the coating composition to the interlayer, drying the applied coating composition, to give a heat-sensitive recording layer (of the invention) which is present together with the carrier substrate and the interlayer in the heat-sensitive recording material.

The heat-sensitive recording material produced with the method of the invention is a laminate which possesses at least one carrier substrate, an interlayer disposed thereon, and also a heat-sensitive recording layer disposed in turn on the interlayer. Regarding the advantages and the preferred configurations of a heat-sensitive recording material with interlayer, see the observations earlier on above.

With regard to preferred configurations and combinations for a coating composition used in a method of the invention, the elucidations given above for the heat-sensitive recording materials of the invention are valid correspondingly (mutatis mutandis where appropriate), and vice versa.

The term "coating composition" in the context of the present invention and in agreement with the general understanding in the field of paper technology refers to coating materials comprising or consisting of pigments or matrix pigments, binders, and additives, said materials being applied to ("coated onto") the paper surface or to layers already applied to paper surfaces, using specific coating apparatus for surface finishing or surface modification of the paper. Papers produced in this way are referred to as "coated papers" and are notable, for example, for better tactile qualities. The term "coating composition" is therefore the generic term for all spreadable coating slips, preparations and/or solutions in the paper industry for the treatment, modification or finishing of a paper surface.

For the application of the coating composition to a carrier substrate or an interlayer, the skilled person knows of various coating technologies, examples including the following: blade coating, coating by film press, cast coating, curtain coating, knife coating, airbrush coating, or spray coating. All of these aforesaid known coating technologies are suitable for applying the coating compositions of the invention to a substrate, preferably a paper which comprises one or more preliminary coats or intermediate coats or else which comprises no preliminary coat or intermediate coat.

A further aspect of the present invention relates to products, preferably entry tickets, TITO tickets (ticket-in, ticket-out), flight, rail, ship or bus ticket, gaming ticket, car park ticket, label, till receipt, bank statements, self-adhesive label, medical and/or technical diagram paper, fax paper, security paper, or barcode labels, comprising a heat-sensitive recording material of the invention.

A further aspect of the present invention is the use of a heat-sensitive recording material of the invention as barcode label, self-adhesive lottery ticket, self-adhesive entry ticket, self-adhesive proof of purchase, self-adhesive label, self-adhesive entry ticket, entry ticket, TITO tickets (ticket-in, ticket-out), flight, rail, ship or bus ticket, gaming ticket, car park ticket, label, till receipt, bank statement, medical and/or technical diagram paper, fax paper, or security paper.

One aspect of the invention also relates to a method for producing a thermally printed, heat-sensitive recording material, having the following steps:

- providing a heat-sensitive recording material of the invention (as defined above and in the claims, preferably as identified above as being preferred) or implementing the production method of the invention (as defined above and in the claims, preferably as identified above as being preferred), to give a heat-sensitive recording material,
- heat-treating the recording material, so that color developers and dye precursors react so as to develop a coloration.

In this case the fatty acid amide used having a number of carbon atoms in the range from 16 to 24 or the mixture of plural fatty acid amides used each having a number of carbon atoms in the range from 16 to 24, preferably octadecanamide and/or N-(hydroxymethyl)-octadecanamide, remains preferably in the solid state at the location of the heat treatment (the site at which in practice the thermal head acts).

The fatty acid amide used having a number of carbon atoms in the range from 16 to 24 or the mixture of plural fatty acid amides used each having a number of carbon atoms in the range from 16 to 24, preferably octadecanamide and/or N-(hydroxymethyl)octadecanamide, therefore preferably does not melt and hence also does not act as a sensitizer.

The coloration formed is preferably part of a printed image, more particularly a printed graphic, an indicium, a pattern, or a recording.

BRIEF DESCRIPTION OF THE DRAWINGS

The appended

FIG. 1 is a comparison of IR spectra in the wavenumber range from around 4000 to 2000 $cm^{-1}$ of the two crystalline forms of the compound of the formula (I);

FIG. 2 is a comparison of IR spectra in the wavenumber range from around 2400 to 400 $cm^{-1}$ of the two crystalline forms of the compound of the formula (I);

FIG. 3 is a comparison of IR spectra of the two crystalline forms of the compound of the formula (I); and FIG. 4 is a comparison of X-ray powder diffractograms of the two crystalline forms of the compound of the formula (I).

DETAILED DESCRIPTION OF THE PRESENTLY PREFERRED EMBODIMENTS

Figure 1:
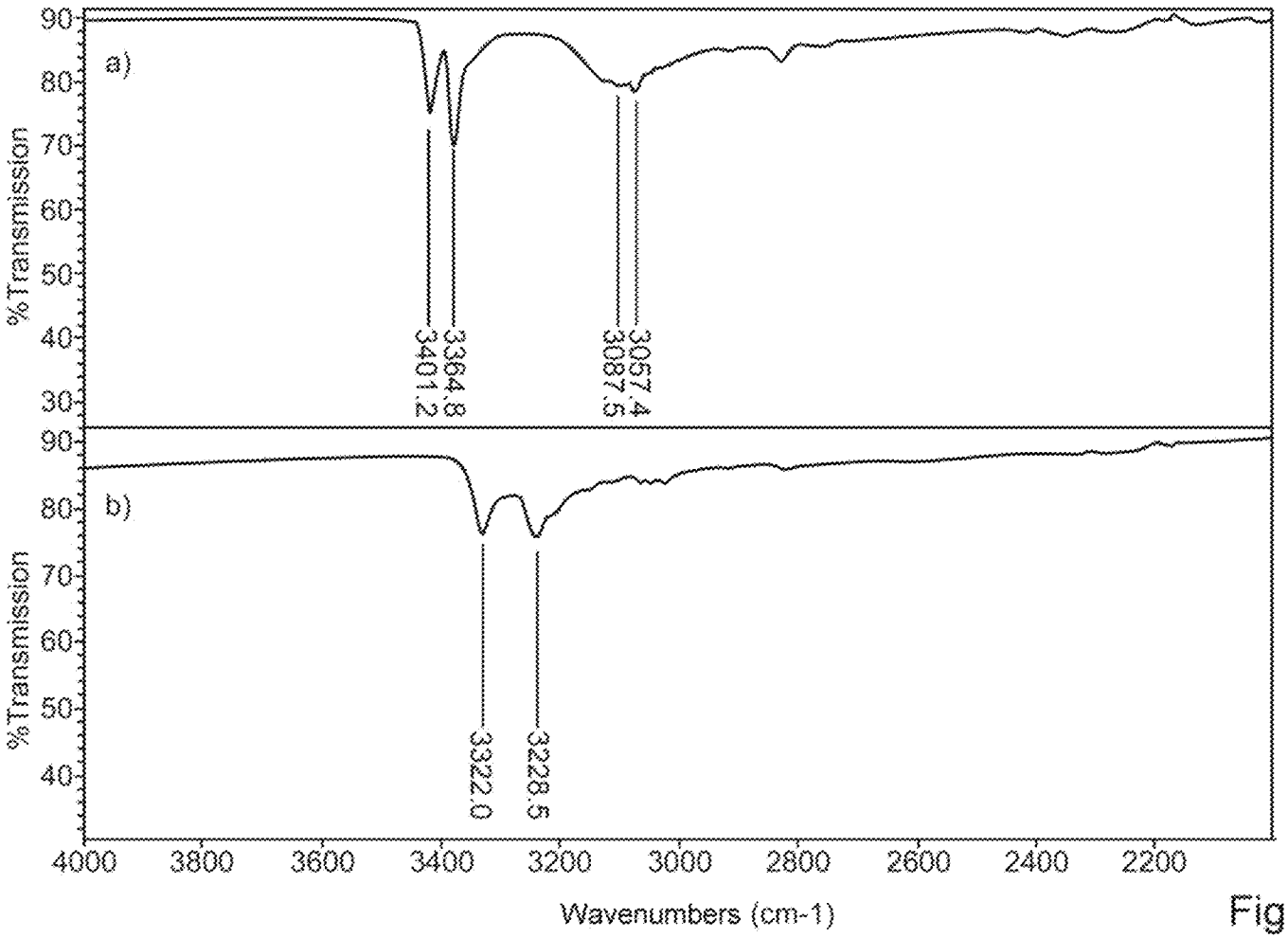
FIGS. 1, 2, 3, and 4 are graphic reproductions (fine drawings) of machine-generated original spectra and machine-generated original diffractograms, respectively.

FIG. 1 shows a comparison of IR spectra in the wavenumber range from around 4000 to 2000 $cm^{-1}$ of the two crystalline forms of the compound of the formula (I). Depicted in the upper part and identified with a) is the IR spectrum of the crystalline form of the compound of the formula (I) used in the invention with a melting point of 175° C. Depicted in the lower part and identified with b) is the IR spectrum of the crystalline form of the compound of the formula (I) having a melting point of around 158° C.

Figure 2:
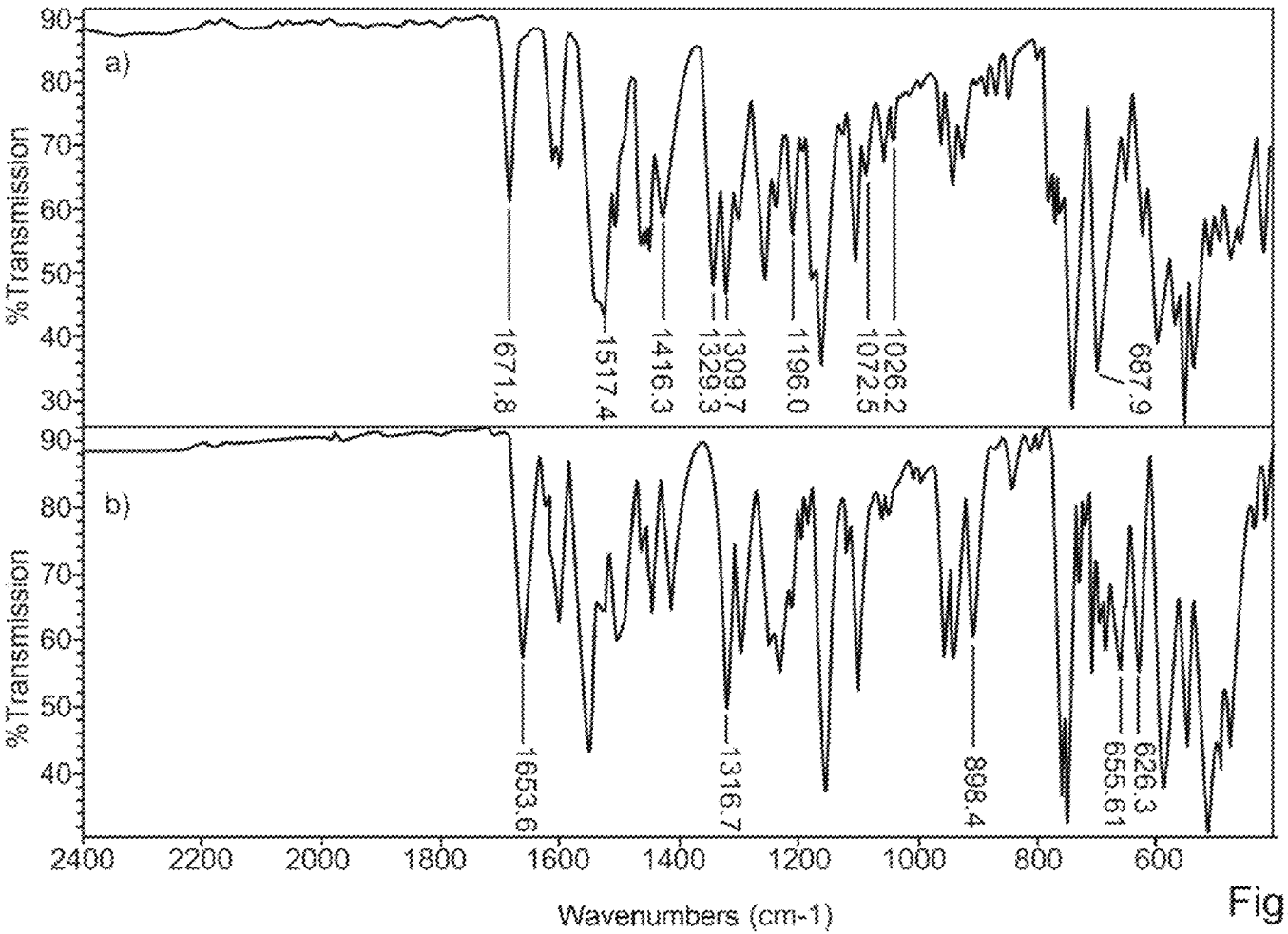

FIG. 2 shows a comparison of IR spectra in the wavenumber range from around 2400 to 400 $cm^{-1}$ of the two crystalline forms of the compound of the formula (I). Depicted in the upper part and identified with a) is the IR spectrum of the crystalline form of the compound of the formula (I) used in the invention with a melting point of 175° C. Depicted in the lower part and identified with b) is the IR spectrum of the crystalline form of the compound of the formula (I) having a melting point of around 158° C.

Figure 3:
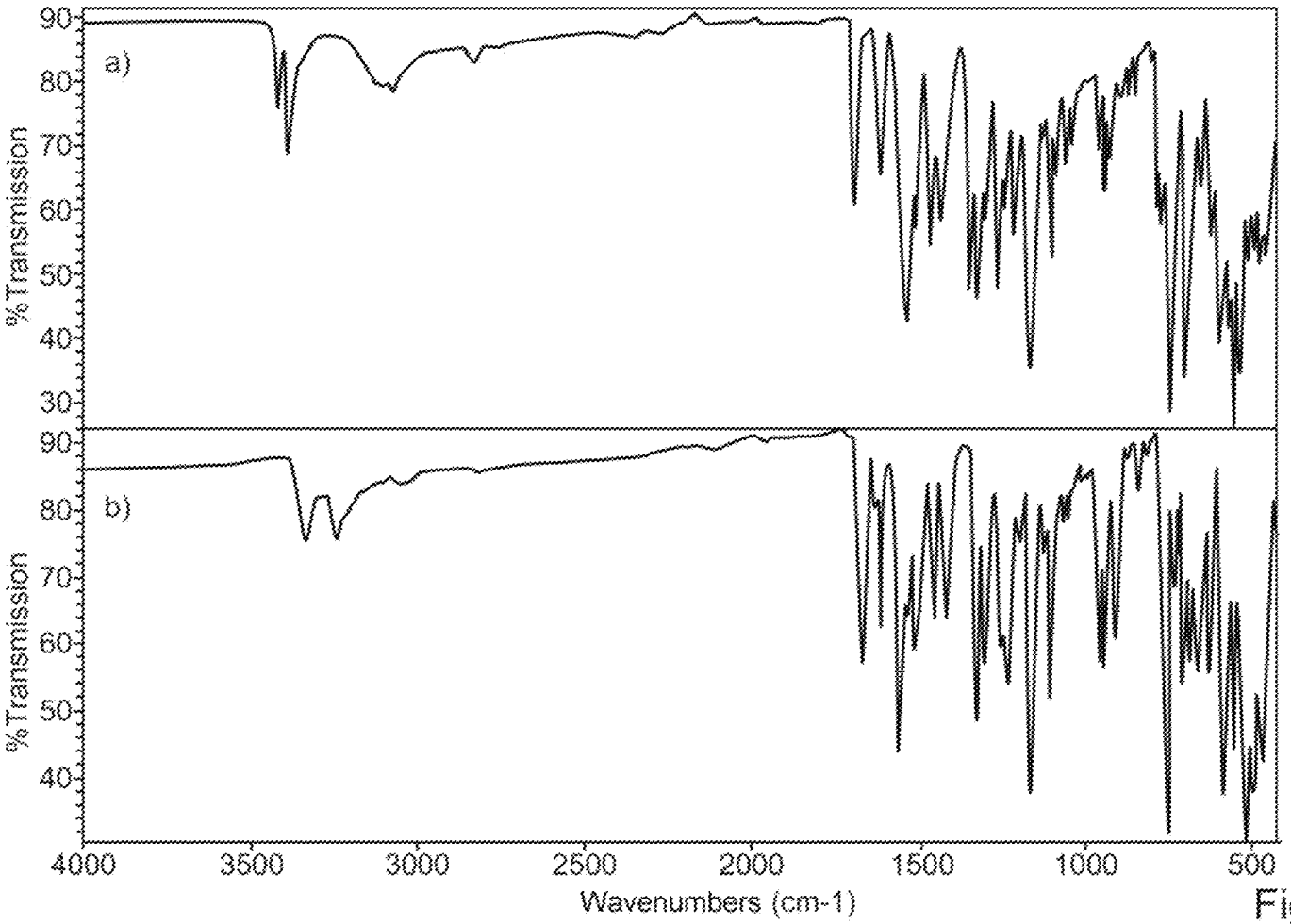

FIG. 3 shows a comparison of IR spectra of the two crystalline forms of the compound of the formula (I). Depicted in the upper part and identified with a) is the IR spectrum of the crystalline form of the compound of the formula (I) used in the invention with a melting point of 175° C. Depicted in the lower part and identified with b) is the IR spectrum of the crystalline form of the compound of the formula (I) having a melting point of around 158° C.

Figure 4:
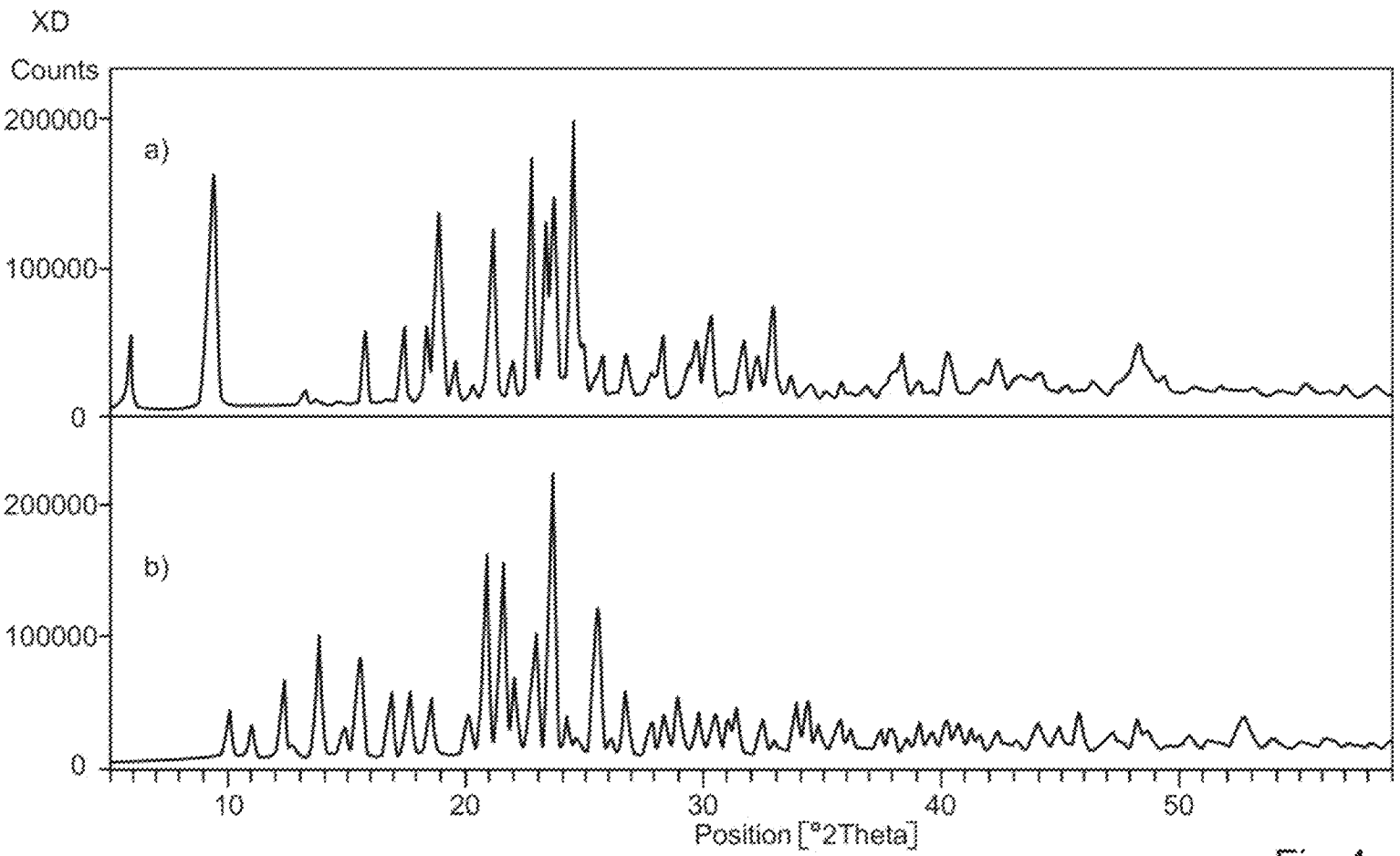

FIG. 4 shows a comparison of X-ray powder diffractograms of the two crystalline forms of the compound of the formula (I). Depicted in the upper part and identified with a) is the X-ray powder diffractogram of the crystalline form of the compound of the formula (I) with a melting point of around 158° C. Depicted in the lower part and identified with b) is the X-ray powder diffractogram of the crystalline form of the compound of the formula (I) used in the invention having a melting point of 175° C.

Selected and preferred aspects of the invention are summarized below:

1. A coating composition for producing a heat-sensitive recording material or heat-sensitive recording layer, comprising one or plural color developers, said one or at least one of the plural color developers being a compound of the formula (I)

(I)

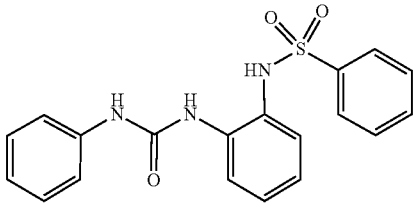

, one or plural dye precursors, one or plural fatty acid amides each having a number of carbon atoms in the range from 16 to 24, as sensitizer, one or more compounds selected from the group consisting of 1,2-diphenoxyethane and ethylene glycol m-tolyl ether.

2. The coating composition or heat-sensitive recording layer according to aspect 1, further comprising one or plural constituents from the group comprising further sensitizers, pigments, dispersants, antioxidants, release agents, defoamers, light stabilizers, and brighteners.

3. The coating composition or heat-sensitive recording layer according to either of aspects 1 and 2, said one or one of the plural fatty acid amides having a number of carbon atoms in the range from 16 to 24 being octadecanamide and/or N-(hydroxymethyl)octadecanamide and/or possessing a melting point which is greater than 103° C., preferably greater than 105° C.

4. The coating composition or heat-sensitive recording layer according to any of the preceding aspects, the ratio of the total mass of the compound of the formula (I) to the total mass of fatty acid amides having a number of carbon atoms in the range from 16 to 24 in the coating composition or the heat-sensitive recording layer being in the range from 1.2:1 to 4:1 and/or the ratio of the mass of the compound of the formula (I) to the mass of octadecanamide and/or N-(hydroxymethyl) octadecanamide in the coating composition or the heat-sensitive recording layer being in the range from 1.2:1 to 4:1.

5. The coating composition or heat-sensitive recording layer according to any of the preceding aspects, the ratio of the total mass of fatty acid amides having a number of carbon atoms in the range from 16 to 24 to the total mass of compounds selected from the group consisting of 1,2-diphenoxyethane and ethylene glycol m-tolyl ether in the coating composition or the heat-sensitive recording layer being in the range from 4:1 to 0.8:1, preferably in the range from 2:1 to 1:1, more preferably in the range from 1.5:1 to 1:1, very preferably in the range from 1.5:1 to 1.2:1.

6. The coating composition or heat-sensitive recording layer according to any of the preceding aspects, comprising one or plural color developers, said one or at least one of the plural color developers being a compound of the formula (I)

(I)

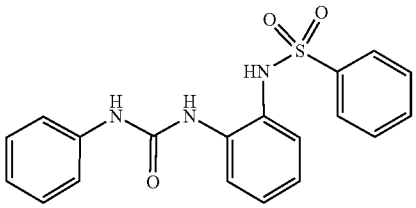

, one or plural dye precursors, octadecanamide and/or N-(hydroxymethyl)octadecanamide, as sensitizer, 1,2-diphenoxyethane and/or ethylene glycol m-tolyl ether, the ratio of the mass of the compound of the formula (I) to the mass of octadecanamide and/or N-(hydroxymethyl) octadecanamide in the coating composition being in the range from 1.2:1 to 4:1, and the ratio of the total mass of octadecanamide and N-(hydroxymethyl)octadecanamide to the total mass of 1,2-diphenoxyethane and ethylene glycol m-tolyl ether in the coating composition being in the range from 2:1 to 1:1, more preferably in the range from 1.5:1 to 1:1, very preferably in the range from 1.5:1 to 1.2:1.

7. The coating composition or heat-sensitive recording layer according to any of the preceding aspects, comprising as sensitizer 1,2-diphenoxyethane or a mixture of 1,2-diphenoxyethane and ethylene glycol m-tolyl ether.

8. A heat-sensitive recording material, comprising a carrier substrate and a heat-sensitive recording layer according to any of aspects 1 to 7.

9. The heat-sensitive recording material, wherein one or plural interlayers are disposed between carrier substrate and heat-sensitive recording layer and/or no further layer is disposed on the side of the heat-sensitive recording layer that faces away from the carrier substrate and/or the carrier substrate consists of paper, synthetic paper, polymeric film, or an assembly of these materials.

10. The use of a fatty acid amide having a number of carbon atoms in the range from 16 to 24 or of a mixture of plural fatty acid amides each having a number of carbon atoms in the range of 16 to 24, preferably use of octadecanamide and/or N-(hydroxymethyl)octadecanamide, for increasing the grease resistance of a heat-sensitive recording material or a heat-sensitive recording layer, comprising one or plural color developers, said one or at least one of the plural color developers being a compound of the formula (I)

(I)

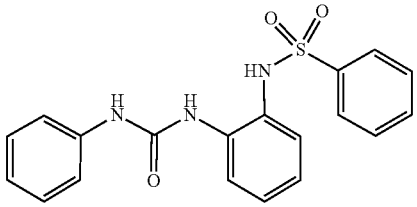

one or plural dye precursors, and as sensitizer, one or more compounds selected from the group consisting of 1,2-diphenoxyethane and ethylene glycol m-tolyl ether.

11. A method for producing a heat-sensitive recording material according to either of aspects 8 and 9 or a heat-sensitive recording layer, having the following steps:

providing or producing a carrier substrate and also a coating composition according to any of aspects 1 to 7, applying the coating composition to the carrier substrate or an interlayer disposed thereon, drying the applied coating composition, to give a heat-sensitive recording layer which is present together with the carrier substrate in a heat-sensitive recording material.

12. The method according to aspect 11, for producing a heat-sensitive recording material according to either of aspects 8 and 9, having the following steps:

providing or producing a carrier substrate with interlayer disposed thereon and also a coating composition according to any of aspects 1 to 7, applying the coating composition to the interlayer, drying the applied coating composition, to give a heat-sensitive recording layer which is present together with the carrier substrate and the interlayer in the heat-sensitive recording material.

13. A method for producing a thermally printed heat-sensitive recording material, having the following steps:

providing a heat-sensitive recording material according to either of aspects 8 and 9 or implementing the method according to either of aspects 11 and 12, to give a heat-sensitive recording material, heat-treating the recording material, so that color developers and dye precursors react so as to develop a coloration.

14. The method according to aspect 13, wherein the fatty acid amide used having a number of carbon atoms in the range from 16 to 24 or the mixture used of plural fatty acid amides each having a number of carbon atoms in the range from 16 to 24, preferably octadecanamide and/or N-(hydroxymethyl)octadecanamide, remains in the solid state at the location of the heat treatment.

EXAMPLES

Determining the Resistance of Heat-Sensitive Recording Materials to Lanolin:

For metrological capture of the resistance of a thermal printout on the heat-sensitive recording materials of the inventive examples and of the noninventive examples with respect to lanolin, test thermal printouts with a checkered black and white design were produced on each of the heat-sensitive recording materials under test, using an Atlantek Model 400 "Thermal Response Test System" instrument from Global Media Instruments, LLC (USA), employing a thermal head having a resolution of 300 dpi and an energy per unit area of 16 mJ/mm$^2$.

Following the production of the test thermal printouts with black and white checkering, and after a rest time of more than 5 minutes, a determination of the print density was carried out at three locations on the black-colored areas of the test thermal printouts, by a TECHKON® SpectroDens Advanced spectral densitometer. The mean was formed from the respective measurement values.

The test thermal printout produced on the heat-sensitive recording material under test was then coated with lanolin hand cream. After an exposure time of 5 and 10 minutes, respectively, the lanolin was carefully dabbed off and then the treated thermal paper printout was stored at 23° C. and 50% humidity. After 4 hours and 24 hours, the thermal paper printout was removed, and again a determination of the print density was carried out at three locations on the black-colored areas of the test thermal printouts, by a TECHKON® SpectroDens Advanced spectral densitometer.

The mean was formed from the respective measurement values.

The resistance of the printed image in percent corresponds to the ratio of the mean of the print density of the black-colored areas before and after the treatment with lanolin and subsequent storage at 23° C. and 50% humidity, multiplied by 100.

In-House Studies:

The results of measurement determined in in-house studies show that the print density of inventive examples decreases less than the print density of noninventive examples. The resistance of the printed image to lanolin, i.e., the grease resistance, is therefore higher for inventive examples than for noninventive examples, in which only a fatty acid amide or only 1,2-diphenoxyethane or ethylene glycol m-tolyl ether was used. The combination of stearamide (octadecanamide) or N-(hydroxymethyl)octadecanamide and 1,2-diphenoxyethane or ethylene glycol m-tolyl ether as sensitizer, used in accordance with the invention, therefore has a synergistic effect.

In further in-house studies, preferred mixing ratios were determined for coating compositions comprising stearamide (octadecanamide) and 1,2-diphenoxyethane (DPE) as well. In carrying out these experimental studies, a coating composition was produced which corresponds very largely to the aqueous application suspension of formulation 1 as per DE 10 2014 107 567 B3 (cf. paragraph [0060] therein). The total amount of octadecanamide (stearamide) and DPE in the in-house studies was 40 mass fractions (corresponding to the 40 mass fractions of sensitizer from formulation 1 from DE 10 2014 107 567 B3). Said 40 mass fractions were distributed in the in-house studies between the octadecanamide and DPE constituents, with the mixing ratios being varied. Results of the studies are reported in table 1 below.

TABLE 1

| | Mass fractions of sensitizers Octadecanamide: 1,2-diphenoxyethane | | | |
|---|---|---|---|---|
| | 20:20 | 23:17 | 25:15 | 27:13 |
| Experimental series I | I-1 | I-2 | I-3 | I-4 |
| Print density before lanolin exposure | 1.16 | 1.23 | 1.21 | 1.13 |

TABLE 1-continued

| | Mass fractions of sensitizers Octadecanamide: 1,2-diphenoxyethane | | | |
|---|---|---|---|---|
| | 20:20 | 23:17 | 25:15 | 27:13 |
| Print density after 5 min lanolin exposure and 4 h exposure time | 0.70 | 0.97 | 0.87 | 0.67 |
| Resistance/% | 60.3 | 78.9 | 71.9 | 59.3 |
| Experimental series II | II-1 | II-2 | II-3 | II-4 |
| Print density before lanolin exposure | 1.15 | 1.24 | 1.20 | 1.13 |
| Print density after 10 min lanolin exposure and 24 h exposure time | 0.18 | 0.32 | 0.24 | 0.27 |
| Resistance/% | 15.7 | 25.8 | 20.0 | 23.9 |

Outline composition for an inventive coating composition and for an inventive heat-sensitive recording layer:

Table 2 specifies a preferred outline composition for a coating composition of the invention and for a heat-sensitive recording layer of the invention. All of the data relate to measurement on oven-dry material; the actual coating composition or actual heat-sensitive recording layer may comprise liquid (especially water); it was therefore subjected to oven drying before determination of the mass fractions.

TABLE 2

| | Mass fraction [%] |
|---|---|
| N-[2-(3-Phenylureido)phenyl]benzenesulfonamide (NKK, color developer) | 8-30 |
| Dye precursor | 4-16 |
| Octadecanamide (fatty acid amide) | 2.4-34 |
| 1,2-Diphenoxyethane (sensitizer) | 2-8.5 |
| Polyvinyl alcohol (PVA, binder) | 6-24 |
| Pigments | 25-55 |
| Total | 100 |

The percentage mass fractions reported in the right-hand column of table 2 add up to a total of 100%. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A coating composition for producing a heat-sensitive recording material, comprising:

at least one color developer, wherein at least one of the at least one color developer being a compound of formula (I)

(I)

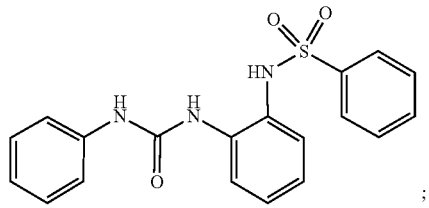

;

wherein the compound of formula (I) is present in a crystalline form which in the IR spectrum has an absorption band at 3401±20 $cm^{-1}$, at least one dye precursor;

at least one fatty acid amide each having a number of carbon atoms in a range from 16 to 24;

a sensitizer comprising at least one compound selected from the group consisting of 1,2-diphenoxyethane and ethylene glycol m-tolyl ether; and a ratio of a total mass of fatty acid amides having a number of carbon atoms in a range from 16 to 24 to a total mass of compounds selected from the group consisting of 1,2-diphenoxyethane and ethylene glycol m-tolyl ether in the coating composition or the heat-sensitive recording layer being in a range from 4:1 to 1.2:1.

2. The coating composition as claimed in claim 1, further comprising at least one constituents from the group consisting of a further sensitizer, a pigment, a dispersant, an antioxidant, a release agent, a defoamer, a light stabilizer, and a brightener.

3. The coating composition as claimed in claim 2, wherein:

the at least one fatty acid amide have a number of carbon atoms in a range from 16 to 24 being octadecanamide and/or N-(hydroxymethyl)octadecanamide and/or possessing a melting point which is greater than 103° C.

4. The coating composition as claimed in claim 3, wherein a ratio of the mass of the compound of the formula (I) to a total mass of fatty acid amides having the number of carbon atoms in a range from 16 to 24 in the coating composition or the heat-sensitive recording layer being in a range from 1.2:1 to 4:1 and/or a ratio of the mass of the compound of the formula (I) to the mass of octadecanamide and/or N-(hydroxymethyl) octadecanamide in the coating composition being in a range from 1.2:1 to 4:1.

5. The coating composition as claimed in claim 1, wherein a ratio of a total mass of fatty acid amides having a number of carbon atoms in the range from 16 to 24 to a total mass of compounds selected from the group consisting of 1,2-diphenoxyethane and ethylene glycol m-tolyl ether in the coating composition being in a range from 1.5:1 to 1.2:1.

6. The coating composition as claimed in claim 1, comprising as sensitizer 1,2-diphenoxyethane or a mixture of 1,2-diphenoxyethane and ethylene glycol m-tolyl ether.

7. The coating composition as claimed in claim 1, the at least one fatty acid amides having a number of carbon atoms in a range from 16 to 24 being octadecanamide and/or N-(hydroxymethyl)octadecanamide and/or possessing a melting point which is greater than 103° C.

8. A coating composition for producing a heat-sensitive recording material or heat-sensitive recording layer, comprising at least one color developer, wherein at least one of the at least one color developers being a compound of a formula (I)

(I)

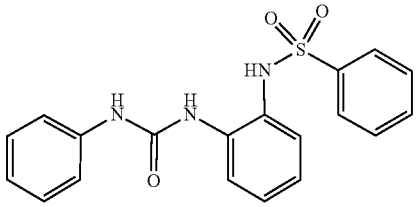

, wherein the compound of formula (I) is present in a crystalline form which in the IR spectrum has an absorption band at 3401±20 $cm^{-1}$, at least one dye precursor;

octadecanamide and/or N-(hydroxymethyl)octadecanamide;

a sensitizer comprising, 1,2-diphenoxyethane and/or ethylene glycol m-tolyl ether, wherein a ratio of a mass of the compound of the formula (I) to a mass of octadecanamide and/or N-(hydroxymethyl)octadecanamide in the coating composition being in a range from 1.2:1 to 4:1, and a ratio of a total mass of octadecanamide and N-(hydroxymethyl)octadecanamide to the total mass of 1,2-diphenoxyethane and ethylene glycol m-tolyl ether in the coating composition being in a range from 1.5:1 to 1.2:1.

9. A heat-sensitive recording material, comprising:

a carrier substrate; and a heat-sensitive recording layer comprising:

at least one color developer, wherein at least one of the at least one color developer being a compound of formula (I)

(I)

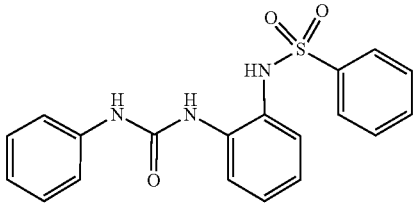

;

wherein the compound of formula (I) is present in a crystalline form which in the IR spectrum has an absorption band at 3401±20 $cm^{-1}$, at least one dye precursor;

at least one fatty acid a amide each having a number of carbon atoms in a range from 16 to 24;

a sensitizer comprising at least one compound selected from the group consisting of 1,2-diphenoxyethane and ethylene glycol m-tolyl ether; and a ratio of a total mass of fatty acid amides having a number of carbon atoms in a range from 16 to 24 to a total mass of compounds selected from the group consisting of 1,2-diphenoxyethane and ethylene glycol m-tolyl ether in the coating composition or the heat-sensitive recording layer being in a range from 4:1 to 1.2:1.

10. The heat-sensitive recording material as claimed in claim 9, further comprising at least one interlayer disposed between the carrier substrate and the heat-sensitive recording layer and/or wherein no further layer is disposed on a side of the heat-sensitive recording layer that faces away from the carrier substrate and/or wherein the carrier substrate consists of paper, synthetic paper, polymeric film, or an assembly of these materials.

11. A heat sensitive recording material comprising:

a carrier substrate; and a heat-sensitive recording layer, comprising:

at least one color developer, wherein at least one of the at least one color developer being a compound of formula (I)

(I)

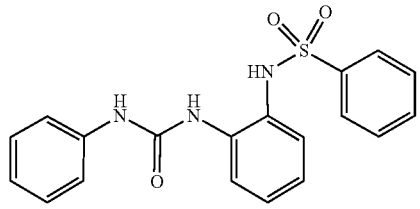

;

wherein the compound of formula (I) is present in a crystalline form which in the IR spectrum has an absorption band at 3401±20 $cm^{-1}$, at least one dye precursor;

at least one fatty acid amide each having a number of carbon atoms in a range from 16 to 24 and comprising octadecanamide and/or (N-hydroxymethyl)octadecanamide;

as a sensitizer, comprising at least one compound selected from the group consisting of 1,2-diphenoxyethane and ethylene glycol m-tolyl ether; and a ratio of a total mass of fatty acid amides having a number of carbon atoms in a range from 16 to 24 to a total mass of compounds selected from the group consisting of 1,2-diphenoxyethane and ethylene glycol m-tolyl ether in the coating composition or the heat-sensitive recording layer being in a range from 4:1 to 1.2:1.

12. A method for producing a heat-sensitive recording material, comprising providing or producing a carrier substrate and also a coating composition comprising:

at least one color developer, wherein at least one of the at least one color developers being a compound of formula (I)

(I)

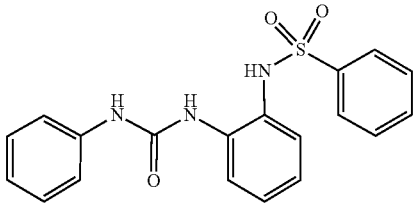

;

wherein the compound of formula (I) is present in a crystalline form which in the IR spectrum has an absorption band at 3401±20 $cm^{-1}$, at least one dye precursor;

at least one fatty acid amide each having a number of carbon atoms in a range from 16 to 24;

a sensitizer comprising at least one compound selected from the group consisting of 1,2-diphenoxyethane and ethylene glycol m-tolyl ether; and a ratio of a total mass of fatty acid amides having a number of carbon atoms in a range from 16 to 24 to a total mass of compounds selected from the group consisting of 1,2-diphenoxyethane and ethylene glycol m-tolyl ether in the coating composition being in a range from 4:1 to 1.2:1;

applying the coating composition to the carrier substrate or an interlayer disposed thereon;

drying the applied coating composition, to give a heat-sensitive recording layer on the carrier substrate as the heat-sensitive recording material.

13. The method as claimed in claim 12, comprising:

providing or producing the carrier substrate with the interlayer disposed thereon applying the coating composition to the interlayer; and drying the applied coating composition, to give a heat-sensitive recording layer on the interlayer which is on the carrier substrate as the heat-sensitive recording material.

14. A method for producing a thermally printed heat-sensitive recording material, comprising:

providing a heat-sensitive recording material comprising: a carrier substrate; and a heat-sensitive recording layer comprising:

at least one color developer, wherein at least one of the at least one color developer being a compound of formula (I)

(I)

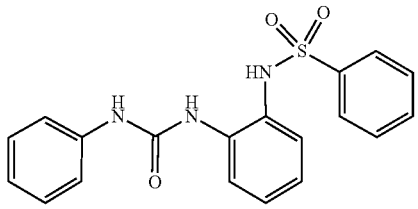

;

wherein the compound of formula (I) is present in a crystalline form which in the IR spectrum has an absorption band at 3401±20 $cm^{-1}$, at least one dye precursor;

at least one fatty acid amide each having a number of carbon atoms in a range from 16 to 24;

a sensitizer comprising at least one compound selected from the group consisting of 1,2-diphenoxyethane and ethylene glycol m-tolyl ether; and a ratio of a total mass of fatty acid amides having a number of carbon atoms in a range from 16 to 24 to a total mass of compounds selected from the group consisting of 1,2-diphenoxyethane and ethylene glycol m-tolyl ether in the heat-sensitive recording layer being in a range from 4:1 to 1.2:1; and heat-treating the heat-sensitive recording material, so that the at least one color developer and the at least one dye precursor reacts so as to develop a coloration.

15. The method as claimed in claim 14, wherein the at least one fatty acid amide remains in the solid state at the location of the heat treating.

16. A heat-sensitive recording material, comprising a carrier substrate and a heat sensitive recording later formed from the coating composition in claim 1.

* * * * *